United States Patent [19]

Malin et al.

[11] Patent Number: 4,588,000

[45] Date of Patent: May 13, 1986

[54] METHOD AND APPARATUS FOR METERING AND DISPENSING VOLATILE LIQUIDS

[75] Inventors: John D. Malin, Reading; Paul Porucznik, Kennington, both of United Kingdom

[73] Assignee: Metal Box public limited company, Berkshire, United Kingdom

[21] Appl. No.: 526,491

[22] Filed: Aug. 19, 1983

[30] Foreign Application Priority Data

Aug. 26, 1982 [GB] United Kingdom ..... 8224489

[51] Int. Cl.[4] ..... B65B 3/04

[52] U.S. Cl. ..... 141/1; 141/98; 141/129; 62/51; 138/27; 137/1; 137/59; 53/55; 53/88; 53/432; 53/510; 277/1; 277/3; 277/59; 277/DIG. 6

[58] Field of Search ..... 141/1-12, 141/37-70, 85-92, 129-192, 98; 277/3, 59, DIG. 6, 1; 53/432, 55, 493, 503, 75, 510, 88; 62/51; 138/26-35; 137/59, 1

[56] References Cited

U.S. PATENT DOCUMENTS

| | | | |
|---|---|---|---|
| 3,248,118 | 4/1966 | Pechy | 277/1 |
| 3,729,946 | 5/1973 | Massey | 62/51 |
| 4,203,299 | 5/1980 | Dinglinger | 62/49 |

FOREIGN PATENT DOCUMENTS

| | | |
|---|---|---|
| 1062671 | 9/1979 | Canada . |
| 1455652 | 11/1976 | United Kingdom . |
| 2091228 | 7/1982 | United Kingdom . |

*Primary Examiner*—Houston S. Bell, Jr.

*Attorney, Agent, or Firm*—Berman, Aisenberg & Platt

[57] ABSTRACT

A metering/dispensing head (10) and system for dispensing small doses of liquid nitrogen into individual filled cans (16) proceeding from a filling station to a closing station. The head includes a nozzle member (32) to which a source of liquid nitrogen under pressure is connected via pipe (12). The lower plane surface (72) of that member cooperates in close sliding relationship with the upper plane surface (70) of a rotary valve disc (40) around which are spaced triangular apertures (68). A small clearance separates those cooperating surfaces, but is of such a size as to effectively prevent loss of liquid nitrogen when the valve disc closes off a downwardly-pointing outlet nozzle (80) which opens into the lower surface of the nozzle member. A jet of liquid nitrogen exiting from said nozzle when uncovered by a said aperture in the valve disc injects a filled can moving beneath the nozzle member with a metered quantity of liquid nitrogen. The nozzle opens into a circular cavity (82) formed in the under side of the nozzle member. The pressure of gaseous nitrogen in that cavity when the nozzle is closed by the valve disc isolates the valve disc from the low temperature liquid nitrogen. The valve disc is exposed to the same atmospheric conditions as the filling station, and is maintained thereby substantially at room temperature. Adjustment of the position of the nozzle radially relative to the valve disc adjusts the size of the said doses of liquid nitrogen.

22 Claims, 12 Drawing Figures

METHOD AND APPARATUS FOR METERING AND DISPENSING VOLATILE LIQUIDS

This invention relates to a method of and apparatus for metering and dispensing volatile liquids, particularly cryogenic liquids, such as liquid nitrogen, in precisely controlled quantities and at high repetition rates, for example up to rates of 2000 or more cycles per minute.

Such method and apparatus find particular application in the field of packaging foods and beverages, especially in metal cans.

In the UK patent specification No. 1 455 652 (Messer Griesheim GmbH), to which the reader is referred, there is disclosed a method of producing an internal pressure in a liquid-containing container, which method comprises introducing into said container, shortly before a sealing operation, a quantity of a liquefied gas (nitrogen or a noble gas) at a low temperature. The creation of such internal pressure enables cans having very thin flexible walls to be used, which cans without such internal positive pressure would exhibit unacceptably low axial load bearing strength and in some cases unsightly inward indentations or buckling of the wall (known in the art as "panelling").

Canadian patent specification No. 1 062 671 (Continental Can Company Inc) likewise discloses, for achieving the same desirable end result, methods of incorporating small measured doses of an inert gas forming material (such as liquid nitrogen) in a container after filling the container and before sealing it, the gas formed by such material after sealing of the container providing within the container a small positive pressure, which pressure prevents panelling of the container walls, and imparts good axial load bearing strength to the sealed container.

Belgian and British patent specification Nos. 890716 and 2 091 228A, respectively, disclose a system for incorporating such small measured doses of, for example, liquid nitrogen into container bodies, e.g. cans after filling but before sealing them. In that system, the metering of the supply of liquid nitrogen into the filled container or can is carried out by a valve which is incorporated in a delivery pipe upstream of a nozzle opening thereof, the valve being incorporated near the base of a local, float-controlled liquid nitrogen reservoir, and in such a way that it is not readily accessible or removable without first discharging the liquid nitrogen contents of the reservoir, and moreover in such a way that it is subjected completely to and operates at the low temperature (−196° C.) of the surrounding liquid nitrogen. In addition, such valve is operated by an electrical solenoid positioned above the local reservoir and having a valve operating rod which passes through and is likewise surrounded by the liquid nitrogen.

Arranging mechanical valves so as to be wholly immersed in or subjected to the temperature of liquid nitrogen increases the difficulty of obtaining satisfactory maintenance-free valve operation over long periods. Moreover, electric solenoid operation of such valves through relatively long push rods also introduces timing difficulties which render more difficult the dispensing at high repetition rates of closely controlled doses of liquid nitrogen.

According to one aspect of the present invention, in a system for metering and dispensing a volatile liquid, such as a low temperature cryogenic liquid (for example liquid nitrogen), in small measured doses at high repetition rates a thermally-insulated liquid delivery pipe has (at a supply end thereof) means for connecting said pipe to a supply source capable of supplying such a liquid, preferably at a predetermined substantially constant pressure, and at the opposite end thereof a nozzle through which said liquid flowing through said pipe from said source may emerge into the local atmosphere in the form of a coherent jet; and said nozzle cooperates closely with a displaceable valve member which is mounted for transverse sliding movement across the free end of the nozzle to, alternatively cover and uncover that free end;

said valve member being exposed to said liquid only at that part thereof (for the time being) lying adjacent said nozzle end, the other parts of said valve member being exposed to said local atmosphere; and said valve member acting to prevent egrees of said liquid from said nozzle when covering said free end, and to permit said jet to flow freely from said nozzle when said nozzle end is uncovered.

With such an arrangement the problems encountered in providing, and operating, satisfactory valve mechanisms for operation at very low temperatures (such as that of liquid nitrogen) are avoided.

Said nozzle is preferably provided with sealing means for cooperating closely with said valve member whereby, when said nozzle is covered by said valve member, substantially all escape of said liquid and vapour/gas derived therefrom is prevented.

Said sealing means may include a continuous sealing member slidably mounted in a gas-tight manner on said nozzle and arranged to contact said valve member under the action of a biassing means, said sealing member and said valve member having plane sealing surfaces which mate together in a sealing manner.

Alternatively and preferably, said sealing means may be constituted by a sealing member secured around said nozzle adjacent said free end thereof, said sealing member and said valve member having cooperating plane sealing surfaces which cooperate closely together in a sealing manner without actually touching one another, and the radial width of said plane sealing surface on said nozzle-carried sealing member and the separation of that sealing surface from the sealing surface on the valve member being maintained such that substantially no loss occurs of vapour/gas derived from said liquid present in said nozzle.

Preferably, said sealing member secured around said nozzle is recessed adjacent said free end of said nozzle, and said sealing surface on that sealing member extends outwardly from the outer boundary of said recess to an extent and in a manner such that a pocket of vapour/gas derived from said liquid in the nozzle is enclosed within said recess by said closely cooperating sealing surfaces.

Said sealing surface of said sealing member may incorporate one or more continuous grooves, each surrounding said recess, there being provided supply duct means for supplying to each such groove (when in operation) an inert sealing gas, such as nitrogen, at a pressure such as to prevent the escape between said sealing surfaces of vapour/gas derived from said liquid in said nozzle.

Said sealing member may also be provided with other ducts which open forwardly and tangentially into said recess, whereby some of said sealing gas may be directed into said recess in the manner of a vortex.

Said valve member is preferably mounted for rotation about a fulcrum, and is provided with rotary driving means for rotating said valve member thereby to successively cover and uncover the nozzle end. Preferably, said rotary driving means is arranged to drive said valve member in synchronism with a line of containers being fed successively beneath the nozzle end on their way to a machine for closing and sealing said containers.

Said rotary valve member may comprise a wheel mounted for rotation by said rotary driving means and having a plurality of spaced radially-projecting arms, each of which cooperates in turn with said nozzle end as said wheel is rotated, thus successively covering and uncovering said nozzle end in the manner referred to above for the purpose of controlling the flow of said liquid from said nozzle.

The radially-projecting arms may be united at their free end parts by circumferential parts so as to form in effect a wheel in which appropriately shaped apertures are spaced apart around the wheel, said wheel being mounted relative to said nozzle end so that each such aperture traverses said nozzle end in turn and allows the liquid jet to pass therethrough.

Preferably, means are provided for varying the relative positions of the nozzle end and the axis of rotation of the valve member, whereby to effect variation in the durations of the respective periods during which said nozzle end is respectively covered and uncovered by said valve member. Additionally, the said apertures may be shaped in a predetermined special manner so as to provide a desirable control characteristic relating the relative positions of the nozzle end and said axis of rotation and the time during which said nozzle end is uncovered.

Conveniently, said nozzle is arranged for movement relative to a stationary axis of rotation of said valve member, and is provided with a servo-motor for effecting closed loop control of the nozzle position in dependence upon a controlled parameter (e.g. internal pressure after closure and sealing) of the containers being treated by the metering system.

According to a second aspect of the present invention there is provided a method of dispensing small metered quantities of a volatile liquid into a surrounding atmosphere at a temperature above the boiling point of said liquid in said atmosphere, which method comprises (a) mounting a displaceable valve member adjacent the free end of a stationary nozzle for transverse sliding movement across and in close cooperation with said nozzle free end to alternatively cover and uncover that free end, said nozzle being disposed at the delivery end of a thermally-insulated liquid delivery pipe, (b) driving said valve member so as to successively cover and uncover said nozzle free end, and (c) supplying to said delivery pipe a said liquid under a pressure sufficient to cause said liquid to emerge from said nozzle when uncovered by the transverse displacement of said valve member into said atmosphere as a coherent jet.

Preferably, said valve member is constituted by a wheel mounted for rotation and having a plurality of spaced radially-extending parts, each of which (on rotation of said wheel) acts to alternatively cover and uncover said nozzle free end, and thereby interrupt and re-establish the flow of said liquid jet from said nozzle end, and said wheel is rotated to cause said liquid to be dispensed.

Advantageously, said spaced radially-extending parts are defined by apertures formed in said wheel at positions spaced around said wheel.

Other features and advantages of the present invention will appear from the description that follows hereafter and from the claims appended at the end of that description.

One system according to the present invention for metering and dispensing desired small doses of liquid nitrogen into open-topped, filled metal cans on a can-filling line prior to the closure and sealing of such cans in an associated can seamer will now be described by way of example and with reference to the accompanying diagrammatic drawings, in which.

Figure 1:
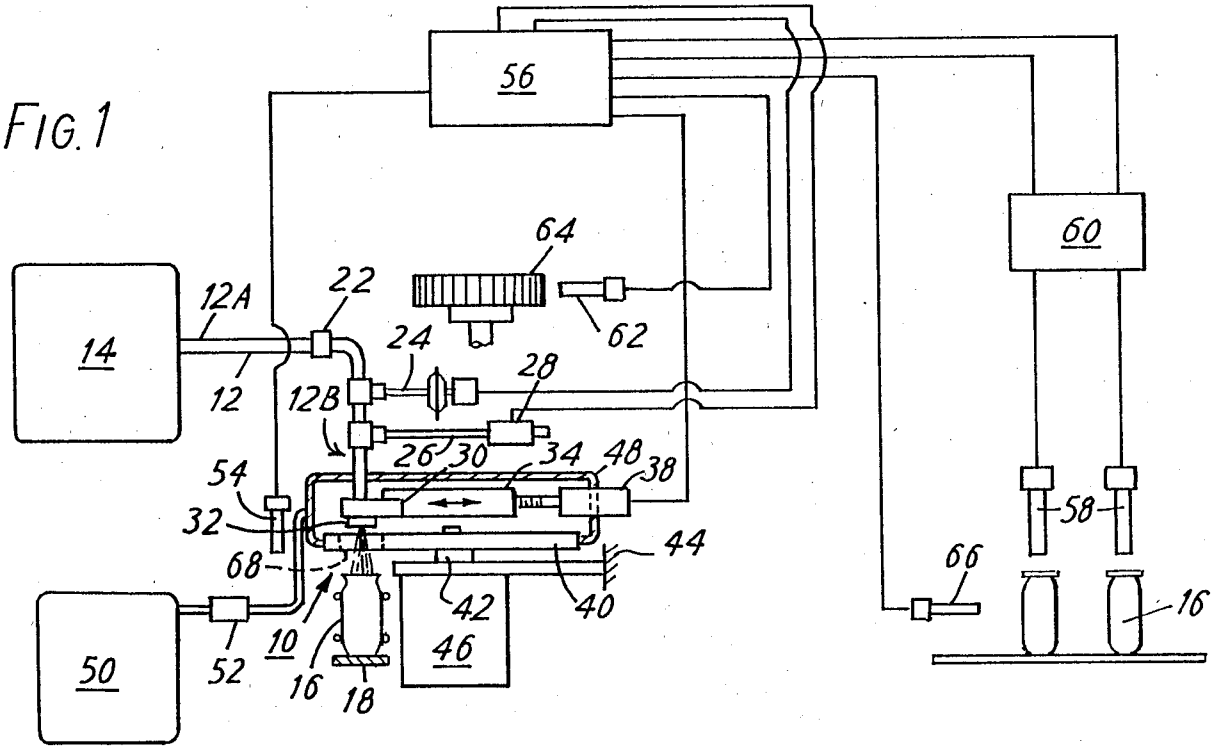
FIG. 1 shows schematically the principal components of the metering and dispensing system and the various means interconnecting those components, as viewed in the direction of the barbed arrow I shown in the FIG. 3.
Figure 3:
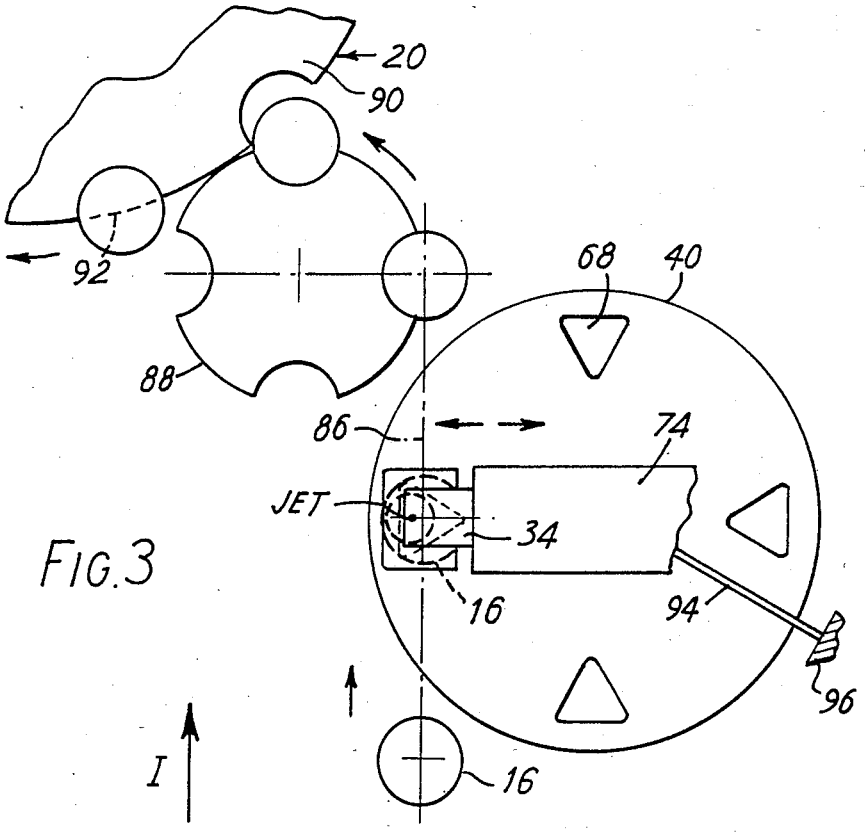
FIG. 3 shows in plan view the positioning of said metering/dispensing head in relation to a line of filled cans being fed from a filling station to an associated can closing and sealing machine (i.e. the said can seamer)

Referring now to the drawings, the system shown in FIG. 1 includes a metering/dispensing head generally indicated at reference 10 which includes a thermally insulated liquid nitrogen supply pipe 12 having a supply end 12A connected to a source 14 of liquid nitrogen under substantially constant pressure, and a flexible delivery end 12B which points downwardly over the path of a train of metal cans 16 travelling on a conveyor belt 18 from a can filling station (not shown), moving as it were downwardly through the paper bearing the Figure to a can closing and sealing machine which is indicated in FIG. 3 as reference 20. Such machine is known in the art and will be referred to hereafter as the 'seamer'.

The delivery end 12B of the supply pipe incorporates in succession an adjustable pressure reducing valve 22, a temperature sensor 24 and an associated vent pipe 26 which is controlled by a solenoid operated valve 28, a solenoid operated shut-off valve 30, and a nozzle member 32 which terminates that delivery end of the supply pipe. All of the supply pipe components mentioned above are suitably thermally insulated so as to minimise the absorption by liquid nitrogen in the supply pipe of heat from the surrounding atmosphere and environment.

Figure 2:
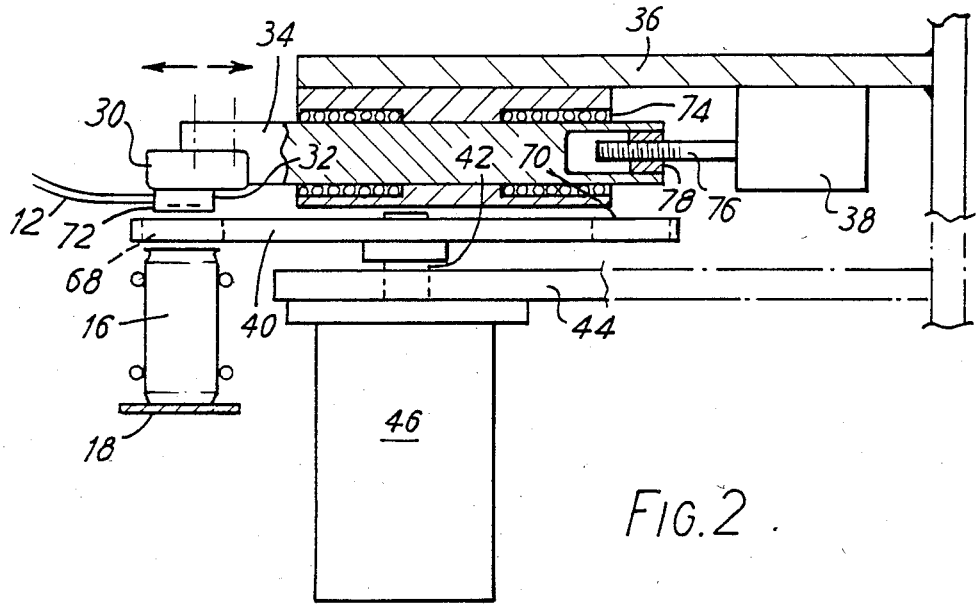
FIG. 2 shows, to a larger scale, a part-sectional side elevation of a metering/dispensing head incorporated in the system of FIG. 1.

The shut-off valve 30 and nozzle member 32 together form a movable assembly which is mounted on a carriage 34 which is itself mounted for movement horizontally, and transversely to the can conveyor belt 18, on a fixed support bracket 36 (FIG. 2) by means of a servomotor 38.

Directly beneath the nozzle member 32 is disposed a peripheral part of a disc-shaped valve member 40 carried in the manner of a wheel on a shaft 42 which is itself carried for rotation in a fixed support bracket 44. The valve wheel is driven in synchronism with the seamer 20 by a driving means 46 coupled to the shaft 42.

An elongate hood or canopy 48 shrouds the region in which the nozzle assembly 32 and the cooperating disc valve 40 are disposed, and extends so as to cover cans 16 passing to the seamer 20. A nitrogen gas supply 50 is connected to the hood 48 via a suitable pressure regulator 52 for the purpose of maintaining a suitable air-excluding nitrogen atmosphere in the said region.

A can sensor 54 is mounted alongside the can conveyor 18 and is arranged to supply to an electrical control unit 56 "inhibit" signals whenever the flow of cans 16 from the filling station towards the seamer 20 has ceased.

Non-destructive can-pressure sensors 58, 60 are disposed alongside the can conveyor on the output side of the seamer 20, and are arranged to supply to the said control unit 56 electrical feedback signals representative of the magnitude of the positive pressures developed within the respective cans leaving the seamer. Such sensors may comprise proximity detecting means arranged to detect the positions, and hence the deflections, of the can closure members as a means of detecting the pressures within the cans.

A seamer-speed sensor 62 arranged alongside a toothed wheel 64 driven by the seamer supplies to said control unit 56, for synchronizing purposes, electrical signals indicative of the seamer speed and position.

A start-up sensor 66, arranged adjacent the pressure sensors 58, 60, detects the absence of pressurized sealed cans adjacent the pressure sensors and supplies to said control unit 56, for control purposes, "over-ride" control signals for use when starting up the system, to override the pressure signals then being provided by the pressure sensors in the absence of cans coming from the seamer.

The metering/dispensing system so far outlined is intended to function in conjunction with the said can filling station and its associated can seamer, the latter being caused to run in synchronism with the filling station, and to supply, apply and seal a closure member on each successive filled can received in turn from the filling station.

The metering/dispensing head is intended to inject into each filled can as it moves below the nozzle member 32 a predetermined small quantity or dose of liquid nitrogen, that quantity being determined according to the free can space available in each filled can above the level of its filling, and being controlled by the control unit 56 in a closed-loop manner so as to achieve a desired positive pressure in the sealed cans coming from the seamer and passing the said can pressure sensors 58, 60.

Since the time taken to achieve closure and sealing of a can after passing below the injector nozzle member 32 depends on the speed at which the cans 16 are being conveyed to and handled by the seamer 20, and since the liquid nitrogen injected into each open can evaporates and escapes continuously from the time of being ejected from the nozzle member 32 until the moment of sealing the can, the quantity of liquid nitrogen to be injected into each can is desirably varied automatically as the speed of the cans passing from the filling station varies (i.e. increased as the can speed falls, and vice versa), so as to avoid generating too high, or too low, a can pressure in the sealed cans leaving the seamer.

This is achieved automatically by synchronising the valve wheel driving means 46 with the seamer 20 (or filling station), for example by using a mechanical drive connecting the valve wheel and the seamer, or by using as said driving means an electrical stepping motor controlled by said control unit 56 in dependence upon the synchronising signals provided by the seamer speed sensor 62.

Control of the flow of liquid nitrogen from the supply source 14 through the pipe 12 to the open topped cans 16 is effected by means of a plurality of valve apertures 68 formed equally-spaced around the said peripheral part of the valve disc 40, rotation of the valve disc being effective to move each such aperture in turn across (and thus uncover) the central part of the lower surface of the nozzle member 32.

The upper surface 70 of the valve disc 40 is machined so as to have at least over said peripheral part a high degree of flatness.

Likewise, the lower surface 72 of the nozzle member 32 is machined to have a similar degree of flatness, and the carriage 34 supporting the nozzle member 32 and its associated shut-off valve 30 is carried in high-precision linear bearings 74 in a manner such as to sustain at all times the lower surface 72 of the nozzle member at a predetermined small clearance distance (of the order of 0.025 to 0.075 mm) from the upper flat surface 70 of the valve disc, regardless of axial movement of said carriage by the servo motor 38, which movement is effected by means of a screw member 76 driven by said motor and a cooperating nut member 78 held in said carriage.

Figure 5:
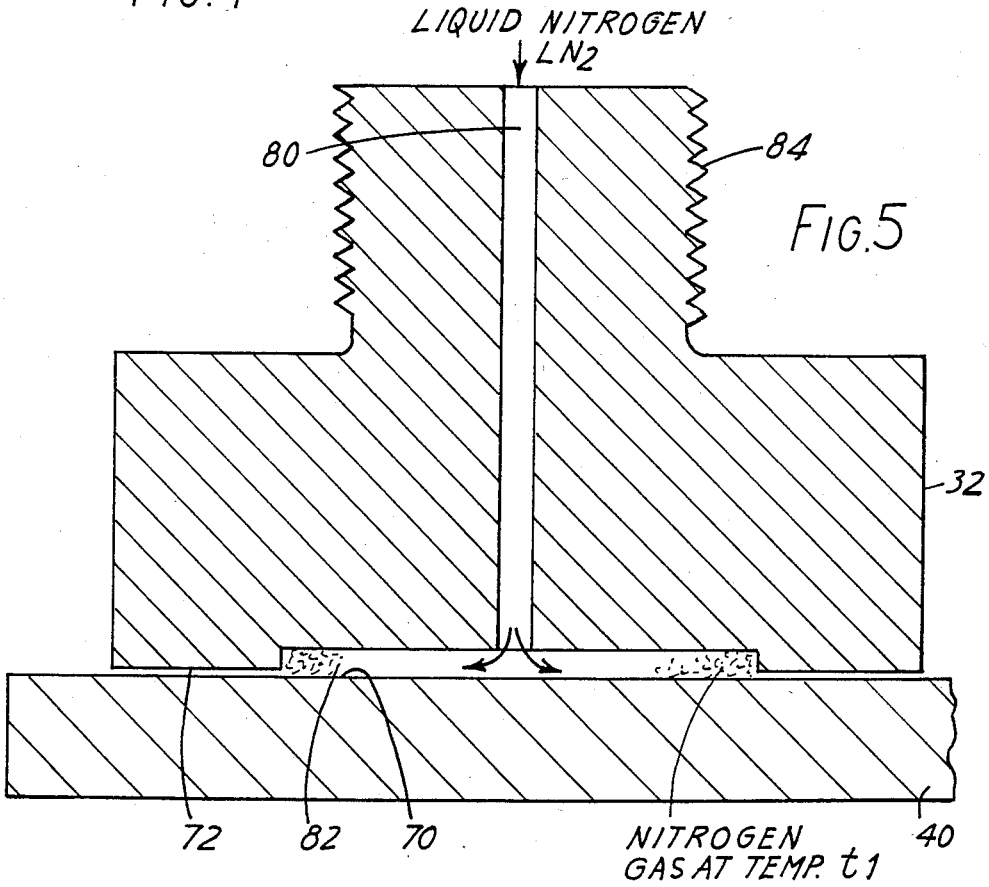
FIGS. 5, 6 and 7 show vertical cross-sections through three different forms of a nozzle member which is used in the said metering/dispensing head.

As shown in the FIG. 5, the nozzle member 32 is provided with a central bore 80 which communicates via said shut-off valve 30 in a liquid-tight manner with the delivery end 12B of the supply pipe 12. At its lower end that central bore opens into a shallow concentric cylindrical recess 82 formed centrally in the lower surface of the nozzle member, which recess has a depth of typically 0.075 to 0.125 mm. The nozzle member is itself secured in the body of the shut-off valve 30 by means of cooperating screw threads 84.

Rotation of said valve disc 40 to an angular position in which a said valve aperture 68 is aligned with said central bore 80 in the nozzle member permits liquid nitrogen to flow freely from said nozzle member in the form of a coherent jet, through said aperture 68 into a can positioned below.

However, further rotation of said valve disc 40 to a position in which said aperture 68 is fully displaced from said nozzle recess 82 brings the liquid nitrogen emerging from said central bore 80 into close proximity with the warmer, upper surface of the valve disc 40, with the result that heat absorbed by the liquid nitrogen from that upper surface causes the immediate evaporation of some of the liquid nitrogen and the creation in said recess of a pocket or cushion of gaseous nitrogen. As a consequence, further delivery of liquid nitrogen through the central bore 80 is resisted by the increasing pressure of the gaseous nitrogen in the recess, and a state of substantial equilibrium is reached in which the liquid nitrogen is held back by the gas cushion at a gas pressure of approximately one atmosphere that is maintained stably without any significant gas flow occurring between the closely-opposed flat surfaces of the nozzle member and valve disc.

The valve disc is thus effectively isolated from direct contact with the liquid nitrogen, at least in a lower range of valve disc speeds, and thus is not subjected to the low temperature (−196° C.) of that nitrogen.

Thus, as each aperture 68 in turn passes the recess in the nozzle member, the jet of liquid nitrogen is re-established, then flows momentarily, and is again interrupted as the aperture passes beyond the recess. The time period during which the jet flows is dependent upon the speed of rotation of the valve disc and the width of the aperture at the position of said central bore in the nozzle member.

Figure 4:
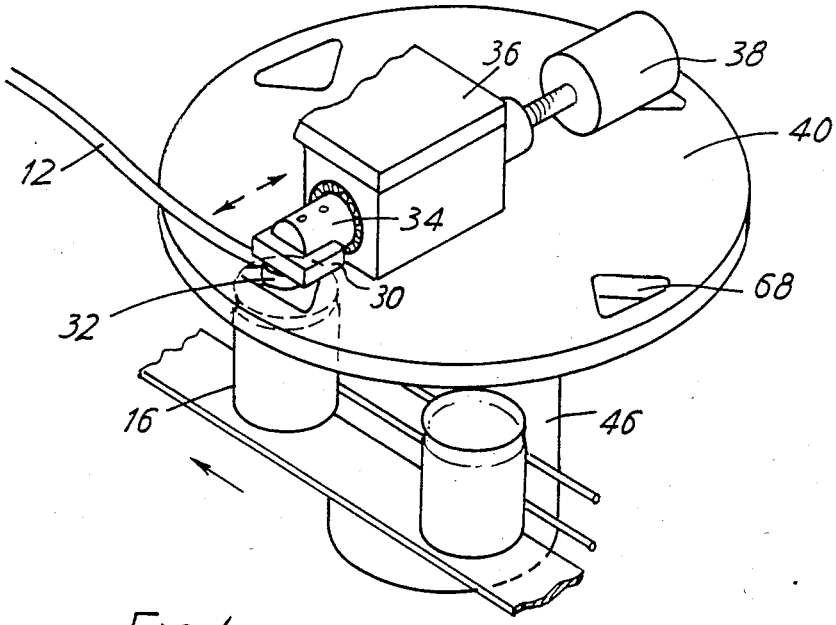
FIG. 4 shows the metering/dispensing head in a pictorial manner.

It will be seen from FIGS. 3 and 4 that the valve apertures are triangular in plan view. Thus, displacement of the carriage 34, by its servo-motor 38, whereby to move the nozzle member 32 radially inwards of the valve disc, has the effect of decreasing the period in which the liquid nitrogen jet flows during the passage of each aperture across the recess 82 in the nozzle member, and vice versa.

In the FIG. 3 the disposition of the valve disc 40 and the associated nozzle member 32 in relation to the seamer 20 is shown, on a reduced scale, with one valve aperture 68 positioned directly beneath the nozzle member 32 and directly above a can 16 carried on the conveyor belt 18. The valve disc has four equi-spaced valve apertures 68 in its peripheral part, and the synchronisation of the valve disc with the supply of filled cans on the conveyor belt 18 is such that each successive valve aperture comes into alignment with the nozzle member as each successive can likewise comes into alignment with that nozzle member. Thus, as each successive filled can moves continuously beneath the valve disc, the synchronised movement of the next valve aperture 68 across the recess in the nozzle member permits the flow of the liquid nitrogen jet for a period which is determined by the position of the nozzle member radially relative to the valve apertures, and the speed of the valve wheel (and hence the speed of the cans).

When a can and the cooperating valve aperture 68 move away from the nozzle member recess 82 the jet flow is terminated, and the can complete with its injection of liquid nitrogen moves further along its linear path 86 and is subsequently engaged by a feed turret 88 (of conventional design) associated with the seamer 20 (again of conventional design). The turret causes the can to be moved along a circular arc and to be delivered into engagement with a rotary table 90 of the seamer, for subsequent closure and sealing as the can moves with the seamer table around another circular path 92.

The supply of nitrogen gas to the gas shield hood 48 and the evaporation of some of the injected liquid nitrogen as the cans move forward to the seamer create and maintain a local atmosphere of gaseous nitrogen through which the open-topped cans move on their way to the seamer. This nitrogen gas shield shrouds the open upper ends of the filled cans and displaces therefrom the air lying on the top of the can filling. This substitution of nitrogen for the air lying in the top of the can is advantageous since it assists in preventing, or reducing the rate of, deterioration of the can filling (i.e. the canned product) after closure of the can.

Moreover, the local atmosphere under the hood 48, being principally gaseous nitrogen, is essentially free of water vapour, so that the deposit of ice on the colder parts of the metering head is at least minimised if not eliminated altogether. However, provision is made for removing any layer of ice that might collect on the cooperating surfaces of the nozzle member and the valve disc. Thus, the valve disc is provided with a closely cooperating mechanical scraper blade 94 that is carried on a stationary supporting framework 96. That blade may, if desired, incorporate heating means for melting any ice collected on the disc. Likewise, means may be provided for passing a scraper wire periodically between the cooperating surfaces of the nozzle member and the valve disc, and means may be provided for heating such scraper wire if that is necessary.

Additionally, said nozzle member and/or said valve disc may be provided with heating means for periodically melting any ice collected on such members, or preventing the formation of ice thereon.

In a simple test rig an apertured rotary valve disc 40 cooperated with a nozzle member 32 having a construction based on that of FIG. 5, and a sealing land radial width of $\frac{3}{8}$ inch (9.525 mm), a central cavity 82 diameter of $\frac{3}{4}$ inch (19.05 mm), and a clearance of 0.025 mm between its annular sealing-land surface 72 and the cooperating surface 70 of the valve disc. With a central supply duct 80 of the nozzle member of diameter 1 mm, and alternatively 1.5 mm, and supplied with liquid nitrogen under a head of one meter of liquid nitrogen, and the valve disc driven at speeds giving up to 800 valve operations per minute, satisfactory valve operation giving individual doses at different speeds was achieved with little, if any, observable loss of liquid nitrogen occurring across the surface of the valve disc.

Figure 6:
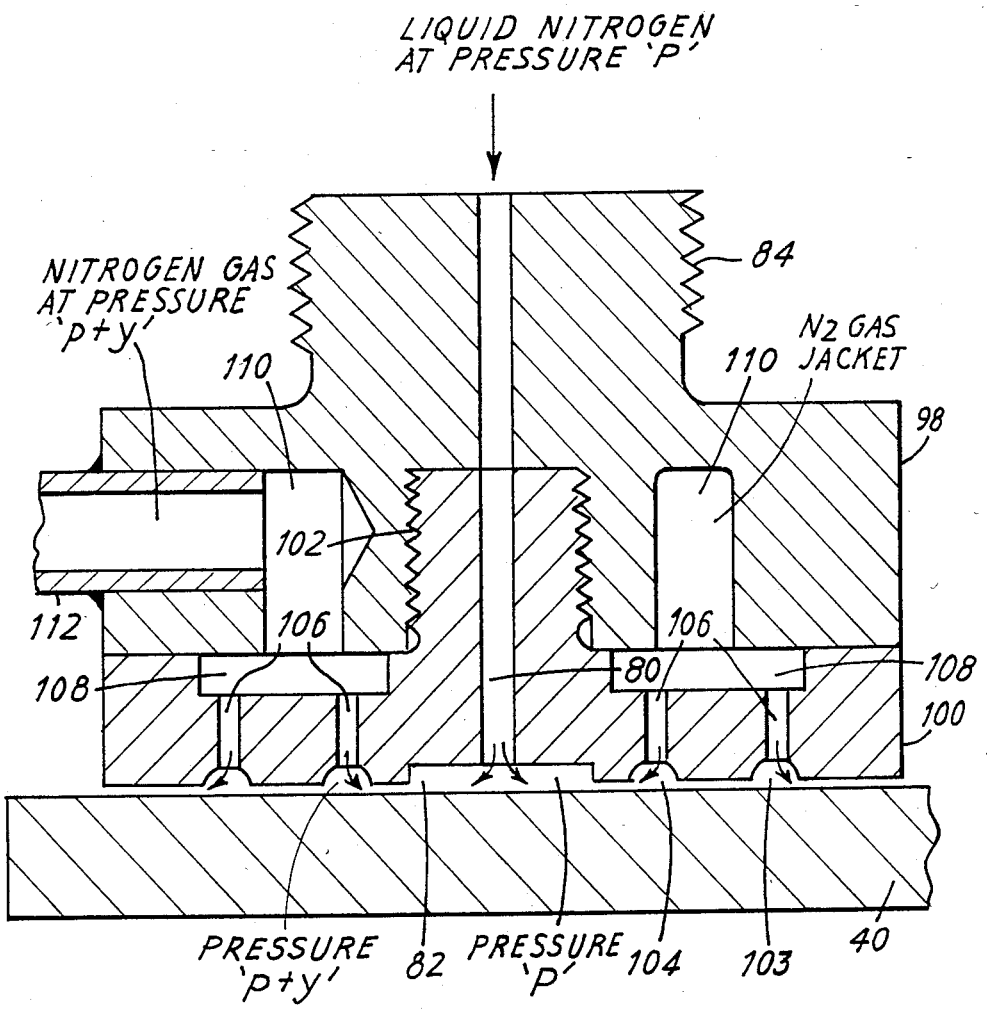

The simple form of nozzle member 32 described above may if desired be replaced by the more complex form shown in the FIG. 6, in which a gas seal is created by means of a separate supply of gaseous nitrogen. In FIG. 6, the nozzle member 32 comprises upper and lower nozzle elements 98, 100 secured together internally by cooperating screw threads 102, and has (as in the arrangement of FIG. 5) a central bore 80 for supplying liquid nitrogen, and at its lower surface a concentric shallow cylindrical recess 82. The lower surface of the nozzle member also incorporates two shallow annular grooves 102, 104 disposed concentrically around the recess 82 and connected by a plurality of small longitudinal ducts 106 with a concentric annular gas distribution chamber 108 formed in the lower nozzle element 100. The chamber 108 communicates with a similar annular gas distribution chamber 110 formed in the upper nozzle element 98. The latter chamber is provided with a gas supply pipe 112 which is intended for connection with a source of inert gas (preferably nitrogen) at a pressure which exceeds by a predetermined small amount that (approximately one atmosphere) normally generated in the nozzle recess 82 by the supply of liquid nitrogen.

As in the case of the arrangement of FIG. 5, when in operation the nozzle member of FIG. 6 is maintained with its lowermost surface at a small closely-maintained distance from the upper surface of the valve disc.

The annular gas shield provided by the higher-pressure nitrogen gas issuing into the annular grooves 103,104 in the annular sealing land assists, particularly at high valve disc speeds, in scouring from the valve disc surface any liquid or gaseous nitrogen that tends to be carried, for example as a result of capillary, centrifugal or viscous drag action, by that surface, thus minimising, if not eliminating altogether, loss of nitrogen across that sealing land surface from the liquid nitrogen supply duct 80.

Figure 7:
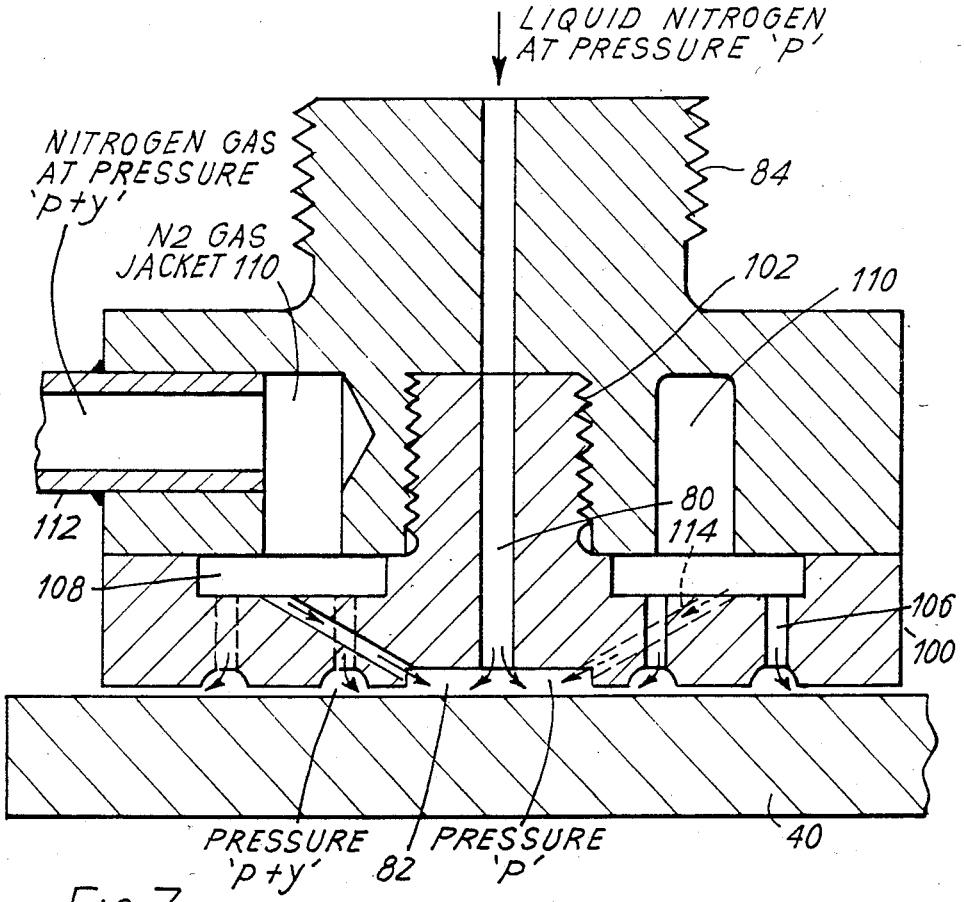
Figure 7A:
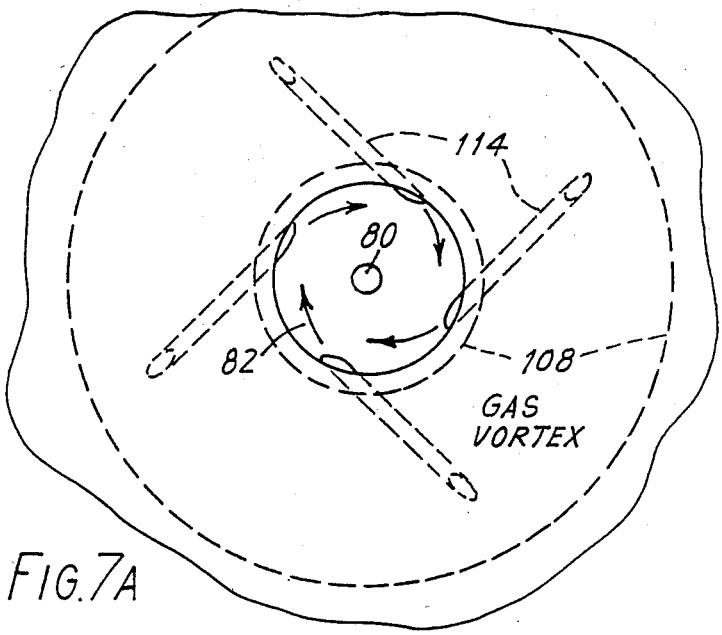
FIG. 7A shows a view of the underside of the nozzle member shown in FIG. 7.

FIG. 7 shows a modified form of the nozzle member shown in FIG. 6. In that modified form the lower nozzle element 100 is additionally provided with a series of equi-spaced, inclined ducts 114 which are intended to direct nitrogen gas from the annular chamber 108 into the central recess 82. Those ducts are inclined in such directions as to direct nitrogen gas forwardly and tangentially into the recess 82, whereby to create when a valve aperture 68 in the valve disc 40 lies adjacent the recess 82 a vortex of nitrogen gas for enclosing, entraining, accelerating and directing the flow of the liquid nitrogen jet. In this connection, it should be stated that it is highly desirable to prevent the jet of liquid nitrogen de-generating into a loose spray of fine globules of liquid nitrogen. What is desired is a coherent jet of liquid nitrogen, or in some cases where a large injection is to be made, a jet composed of relatively large globules of liquid nitrogen.

Figure 8:
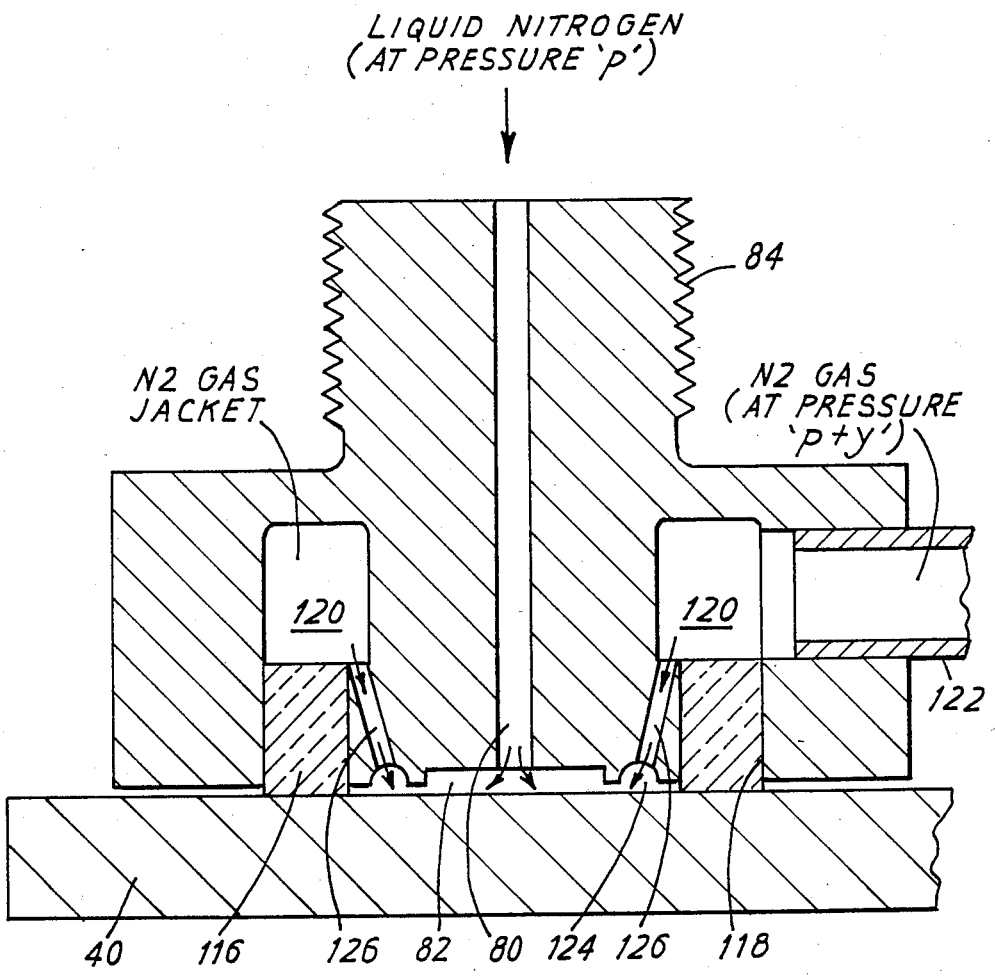
FIG. 8 shows a vertical cross-section through an alternative form of said nozzle member, which form utilizes a gas sealing technique different from that used in the nozzle members of the FIGS. 5 to 7A.

Whereas in the nozzle members described above with reference to the FIGS. 1 to 7, the escape of liquid nitrogen from the nozzle member 32 when in the closed condition, with the valve disc surface adjacent and covering the said recess 82, has been prevented (or at least minimised) by the pressure of nitrogen created in that recess by the liquid nitrogen and maintained there by the high pressure-drop occurring across the annular gap between the closely cooperating but not touching surfaces of the nozzle member and the valve disc, in the alternative arrangement of FIG. 8 escape of nitrogen gas from the recess 82 is prevented (or at least substantially hindered) by a ceramic sealing ring 116, preferably of silicon carbide, which is slidably carried in a close fitting manner in an annular channel 118 formed in the lower part of the nozzle member 32 and which is biassed into physical contact with the upper surface of the valve disc.

The upper surface of that sealing ring is subjected to, and is thus biassed by, a downward pressure of nitrogen (or other inert) gas present in an annular distribution chamber 120 which is disposed above the sealing ring and which is connected to a source of said gas at a suitably high pressure via a pipe 122.

An annular groove 124 formed in the lower surface of the nozzle member between the sealing ring 116 and the central recess 82 is also connected with that annular distribution chamber 120 by a series of inclined ducts 126, and is consequently supplied with sealing gas at a pressure slightly greater than that of the nitrogen cushion present in the central recess 82. When a valve aperture 68 moves into alignment with that recess, the flow of sealing gas through those inclined ducts 126 forms a vortex (as in the arrangement of FIG. 7), and so helps to stabilise and maintain the flow of a coherent jet of liquid nitrogen from the nozzle member.

Since liquid nitrogen present in the central bore 80 of the nozzle member will continuously absorb heat from the valve disc 40, via the cushion of nitrogen gas in the central recess 82, and generally from its surroundings through the thermal insulation enclosing the metering/-dispensing head, it is possible in the event of a temporary hold-up in the supply of filled cans 16 from the filling station that the supply of liquid nitrogen in the central bore 18 recedes some way under the growing back pressure of the nitrogen cushion in the central recess. Hence, on restarting operations after such a hold-up, one or more cans may not receive an injection of liquid nitrogen, or a sufficient injection of liquid nitrogen. To avoid this situation arising, the said temperature sensor 24 operates to detect the temperature in the central bore 80 of the nozzle member at a position just above the shut-off valve 30. A rise in temperature at this position above the temperature of liquid nitrogen (i.e. above −196° C.) indicates the presence of nitrogen gas instead of liquid nitrogen.

The detection of this condition by the sensor 24 is signalled through the control unit 56 to the solenoid operated valve 28, which thereupon operates and vents the accumulated nitrogen gas through pipe 26 to atmosphere, thus permitting the liquid nitrogen to advance once again towards the recess 82 in the lower surface of the nozzle member.

Figure 9:
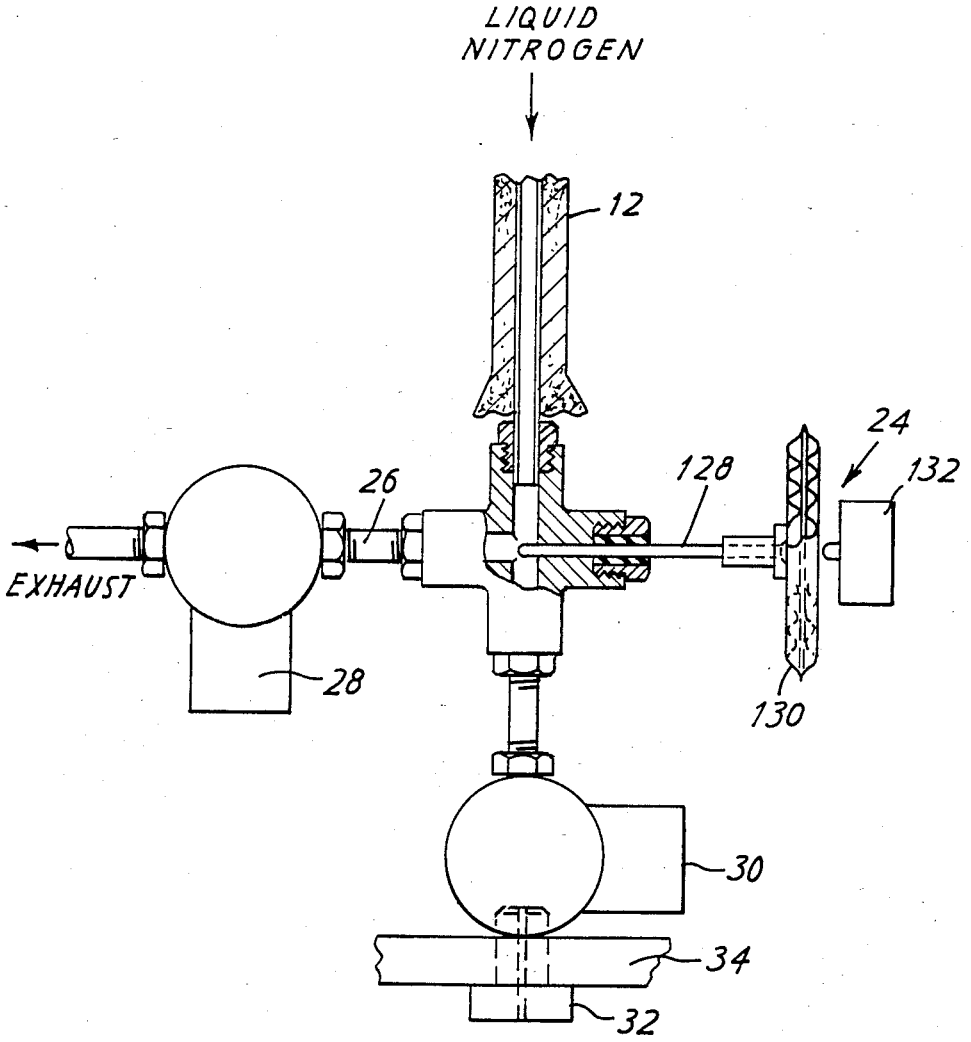
FIG. 9 shows a front elevation, partly in section, of an automatic gas venting system incorporated in the said metering/dispensing head.

One arrangement for achieving this venting operation is shown in FIG. 9, where the temperature sensor 24 comprises a capillary tube 128 having one end thereof sealed and protruding into the liquid nitrogen supply pipe 12 and being connected at its other end with a pressure responsive diaphragm-type actuator 130. The latter is arranged to operate a microswitch 132 when the pressure of the gas sealed in the capillary tube and actuator reaches a predetermined high level indicative of the presence of nitrogen gas surrounding the sealed end of the capillary tube.

Figure 10:
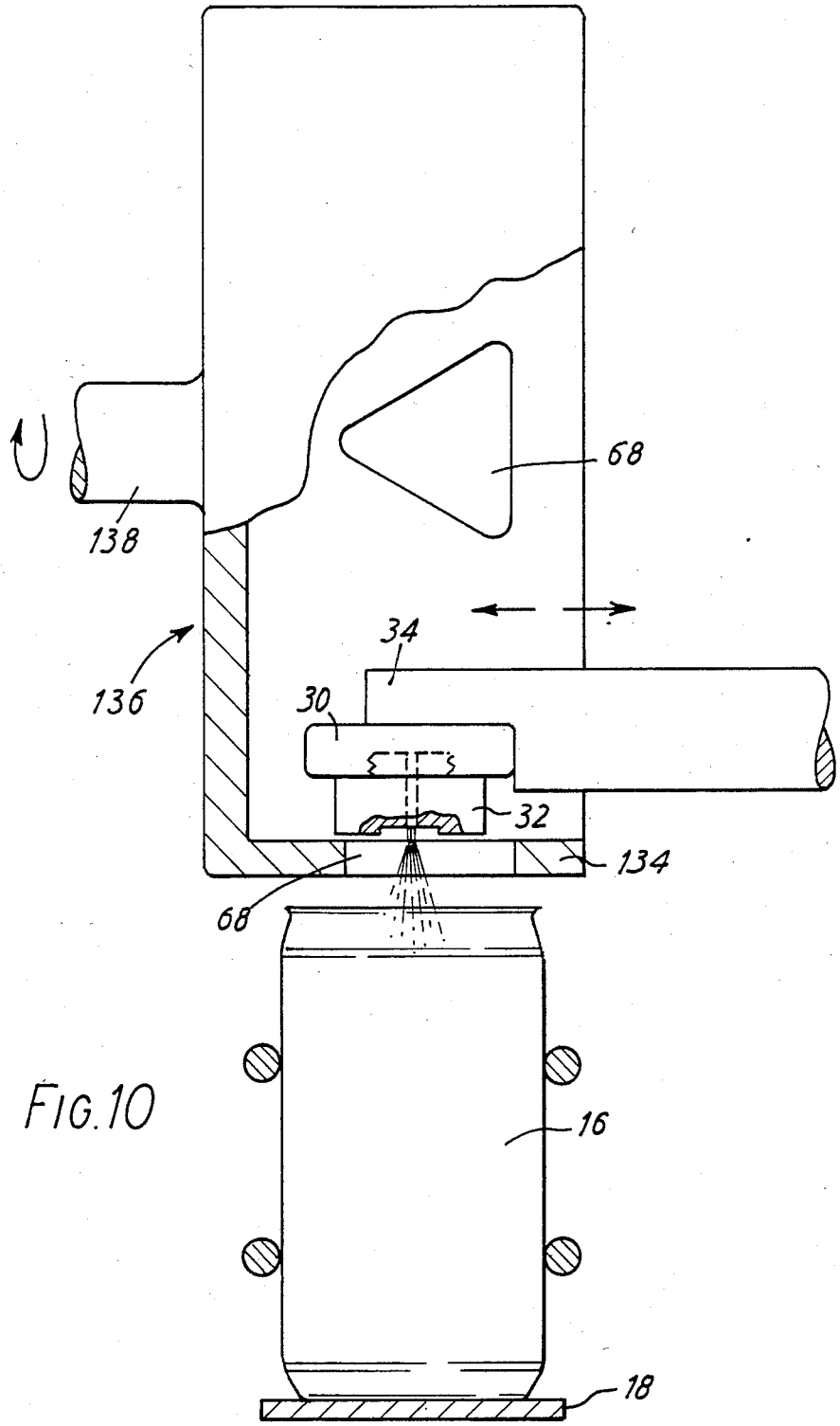
FIG. 10 shows an alternative form of metering/dispensing head for use in the system of FIG. 1, in which alternative form a rotary valve member different to that of the earlier Figures is used.

Whereas in the systems described above, the valve apertures 68 have been formed in a rotary valve member constituted as a flat disc 40 carried on a shaft 42 for rotation about a vertical axis, an alternative form of rotary valve member as illustrated in FIG. 10 may be used instead. In that alternative valve member the apertures 68 are formed in an annular rim 134 of a cup-shaped valve member 136 carried on a shaft 138 arranged for rotation about a horizontal axis. In this case, the lower surface of the valve member 32 conforms, preferably, to the cylindrical shape of the cooperating inside surface of the cup-shaped valve member 136, and is held at the said closely-maintained distance from that inside surface of the valve member.

Though the valve apertures 68 disclosed above have a preferred triangular shape, apertures having other useful shapes may be used instead, for example the apertures may be of semi-circular configuration, or of a non-symmetrical triangular shape.

The valve disc 40 may, if desired, be constituted instead by a star-wheel in which a plurality of arms radiate from a central boss carried on said shaft 42, each such arm being arranged to act in turn to successively cover and uncover the nozzle member 32. Such a star-wheel would be obtained by removing from the valve disc 40 those parts lying radially outwards of and bounding the respective apertures 68.

Figure 11:
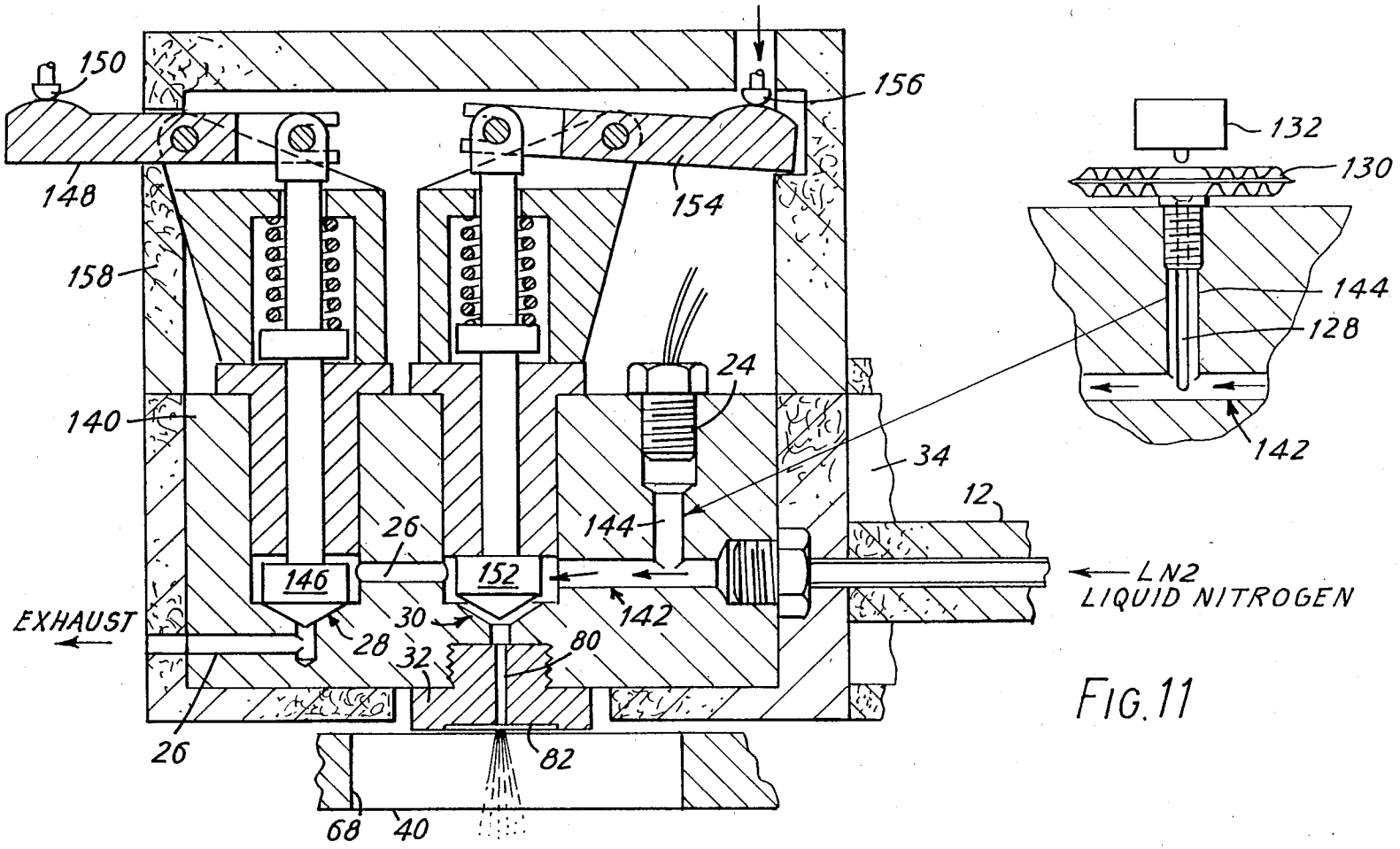
FIG. 11 shows a vertical cross-section through an alternative to the arrangement of FIG. 9.

In an alternative metering/dispensing head, the alternative arrangement of FIG. 11 is used. In that Figure, parts which correspond to equivalent parts of the arrangement of FIG. 9 bear the same references as the corresponding parts in FIG. 9.

Thus, valve nozzle 32 is secured into the base of a thermally-insulated valve block 140, with its liquid nitrogen supply duct 80 communicating with a duct system 142 which is connected at its right hand end with the liquid nitrogen supply pipe 12 and which at its left hand end opens to the environment (exhaust) via a vent duct 26. The duct system includes adjacent the liquid nitrogen supply pipe 12 a teed duct 144 in which is secured a temperature sensor 24, which may be constituted, for example, as a platinum electrical resistance wire element, a thermo-couple, or a gas-filled capillary tube 128 connected, as in the case of FIG. 9, with a diaphragm type actuator 130 which cooperates with an electrical micro-switch 132 in the manner described with reference to FIG. 9.

The vent duct 26 is controlled by a valve 28, of which the valve member 146 is spring-biassed to the closed position, and is opened through a double-ended lever 148 by a pneumatic or other form of mechanical actuator (not shown) of which the output member is partly shown at 150. That actuator operates under the control of the temperature sensor 24 to open the vent duct 26 to exhaust whenever the temperature sensor 24 detects the presence of gaseous instead of liquid nitrogen.

The flow of liquid nitrogen to the valve nozzle duct 80 from the duct system 142 is controlled by a shut-off or isolator valve 30 of which the valve member 152 is likewise spring-biassed to the normally-closed position thus isolating the liquid nitrogen supply from the nozzle member, and is opened via a double-ended lever 154 by a pneumatic or other form of mechanical actuator (not shown) of which the output member is partly shown at 156. That actuator is ineffective to open the isolator valve 30 except when the control system therefor detects simultaneously that the associated can-filling station is in the operative condition ready to supply filled cans to the seamer, and that the supply of liquid nitrogen is detected by the temperature sensor 24.

The whole of the metering/dispensing head is suitably protected by a thermal insulation jacket 158.

By this alternative arrangement the heat sources constituted by the electrical solenoids of the venting and shut-off valves 28 and 30 of FIG. 9 have been removed from the vicinity of the liquid nitrogen supply pipe and valve nozzle member.

It should be observed that in all of the apparatus described above, all parts that have direct contact with the liquid nitrogen are provided with adequate thermal insulation to prevent excessive absorption by the liquid nitrogen of heat from the surrounding environment.

Whereas the system disclosed above has been described in relation to the dosing of filled metal cans, it will be appreciated that the system may equally well be applied to the dosing with liquid nitrogen (or other useful gas) of other forms of filled container, e.g. plastics containers, or containers made of a composite material which includes metal, paper and/or plastics materials.

Moreover, the system may be used in other contexts where a dose of liquid nitrogen or other suitable gas is injected into a container for purposes other than that of creating a suitable strength-inducing positive internal pressure. Such doses of a liquid gas may be used, for example, to simply de-aerate or flush the free space in a container before closing, or even to reduce the magnitude of a final vacuum pressure induced in the closed container.

The metering/dispensing head arrangements described above have, in comparison to the prior art referred to herein, the following substantial advantages:

(i) no moving valve part is submerged in or maintained at or near the low temperature of the liquid nitrogen;

(ii) the moving valve member (disc 40) is disposed in and subjected to the environment of the can filling line;

(iii) since only a relatively small part of the valve disc 40 lies adjacent the nozzle member 32, the valve disc has a temperature close to that of the environment in which it is disposed (i.e. close to room temperature);

(iv) the valve disc 40 is readily accessible for maintenance purposes, and can be removed after first closing the shut-off valve 30;

(v) valve operation is a continuous one (rotation), and not a discontinuous one (reciprocation), and does not require the use of valve biasing springs;

(vi) synchronisation of the valve disc with the can filling line is readily achievable; and (vii) the amount of liquid nitrogen injected into each filled can is automatically related to the speed at which it is moving towards the seamer.

We claim:

1. Apparatus for metering and dispensing predetermined small quantities of a low-temperature volatile liquid into a surrounding atmosphere (referred to hereafter as said atmosphere) which is substantially at room temperature and pressure, which temperature is substantially above the boiling point of the volatile liquid when in said atmosphere, which apparatus includes:

(a) a supply source of said volatile liquid at a predetermined substantially-constant pressure;

(b) delivery means for conducting liquid from the supply source; the delivery means comprising a pipe having, at opposite ends, a supply end and a delivery end; the supply end being connected to said supply source, and the delivery end having a nozzle with a free end and an aperture therethrough; the pipe being thermally-insulated to prevent the liquid flowing therethrough from boiling; the free end of the nozzle being formed and disposed so that liquid flowing therethrough from the supply source emerges from the aperture in said nozzle directly into said atmosphere in a coherent jet form; and (c) a flow-controlling valve disposed adjacent to the aperture and external to the nozzle, the valve comprising a displaceable valve member mounted for transverse movement across and in close cooperation with said aperture to cover and uncover said aperture alternately, said valve member being disposed wholly in said atmosphere and exposed to said low-temperature liquid only at that part thereof which, at a particular time, is adjacent said nozzle, all other parts of the valve member being exposed to said atmosphere; said valve member preventing egress of said liquid from said nozzle when covering the aperture and permitting the liquid to flow freely from said nozzle in the coherent jet form directly into said atmosphere when the aperture is uncovered thereby.

2. Apparatus according to claim 1, wherein said nozzle comprises sealing means which cooperates closely with said valve member to prevent, when said nozzle is covered by said valve member, substantially all escape of said liquid and vapour/gas derived therefrom.

3. Apparatus according to claim 2, wherein said sealing means is constituted by a sealing member disposed around said nozzle adjacent said free end thereof, said sealing member and said valve member having cooperating plane sealing surfaces which cooperate closely together in a sealing manner without actually touching one another, and the radial width of said plane sealing surface on said sealing member and the separation of that sealing surface from the sealing surface on the valve member being maintained such that substantially no loss of vapour/gas, derived from said liquid present in said nozzle, occurs.

4. Apparatus according to claim 3, wherein said sealing member disposed around said nozzle has a recess adjacent said free end of said nozzle, and said sealing surface on said sealing member extends outwardly from the outer boundary of said recess to an extent and in a manner such that a pocket of vapour/gas derived from said liquid in the nozzle is enclosed within said recess by said closely cooperating sealing surfaces.

5. Apparatus according to claim 4, wherein said sealing surface of said sealing member incorporates one or more continuous grooves each surrounding said recess, the apparatus comprising supply duct means for supplying to each such groove, when in operation, an inert sealing gas at a pressure which prevents the escape between said sealing surfaces of vapour/gas derived from said liquid in said nozzle.

6. Apparatus according to claim 5, wherein said sealing member further comprises other ducts which open forwardly and tangentially into said recess to direct some of said sealing gas into said recess in the manner of a vortex.

7. Apparatus according to claim 2, wherein said sealing means includes a continuous sealing member slidably mounted in a gas-tight manner around said nozzle, and biasing means arranged to bias said sealing member into contact with said valve member, said sealing member and said valve member having plane sealing surfaces which mate together in a sealing manner.

8. Apparatus according to claim 7, wherein said nozzle incorporates an annular chamber and said continuous sealing member comprises an annular piston slidably carried in said annular chamber and biased into contact with said valve member by an inert sealing gas, constituting said biasing means, supplied under pressure to said annular chamber.

9. Apparatus according to claim 8, wherein said sealing gas is also supplied via ducts communicating with said annular chamber to the space enclosed by said annular piston and lying between the cooperating surfaces of said nozzle and said valve member.

10. Apparatus according to claim 9, wherein said ducts open into an annular groove formed in said cooperating surface of said nozzle.

11. Apparatus according to claim 10, wherein said ducts communicating with said annular chamber are inclined and directed so as to create in said space enclosed by said annular piston a vortex of said sealing gas when said nozzle is uncovered by said valve member.

12. Apparatus according to claim 1, wherein said valve member is mounted for rotation about a fulcrum, and said valve operating means comprises a rotary driving means for rotating said valve member thereby to successively cover and uncover the nozzle end.

13. Apparatus according to claim 12, wherein said rotary driving means is arranged to drive said valve member in synchronism with a line of containers being fed successively beneath said nozzle end on their way to a machine for closing and sealing said containers.

14. Apparatus according to claim 12, wherein said rotary valve member comprises a wheel mounted for rotation by said rotary driving means and having a plurality of spaced radially-projecting arms, each of which cooperates in turn with said nozzle end as said wheel is rotated whereby to successively cover and uncover said nozzle end in the manner referred to above for the purpose of controlling the flow of said liquid from said nozzle.

15. Apparatus according to claim 14, wherein the radially-projecting arms are united at their free end parts by circumferential parts so as to form in effect a wheel in which appropriately shaped apertures are spaced apart around the wheel, said wheel being mounted relative to said nozzle end so that each such aperture traverses said nozzle end in turn and allows the liquid jet to pass therethrough.

16. Apparatus according to claim 14, wherein there is provided means for varying the relative positions of said nozzle end and the axis of rotation of the valve member, whereby to effect variation in the durations of the respective periods in which said nozzle end is respectively covered and uncovered by said valve member.

17. Apparatus according to claim 16, wherein the said radially-projecting arms are shaped in a predetermined manner so as to provide a desired control characteristic relating the relative positions of said nozzle end and said axis of rotation and the time during which said nozzle end is uncovered.

18. Apparatus according to claim 17, wherein said nozzle is arranged for movement relative to a stationary axis of rotation of said valve member, and is provided with a servo-motor for effecting closed loop control of the nozzle position in dependence upon a controlled parameter of a succession of containers being treated by the metering and dispensing apparatus.

19. Apparatus according to claim 18, wherein said controlled parameter is the internal pressure developed in each said container after being sealed.

20. A method of dispensing small metered quantities of a low temperature volatile liquid into a surrounding atmosphere which is substantially at room temperature and pressure (hereafter referred to as said atmosphere), which temperature is substantially above the boiling point of said liquid when in said atmosphere, which method comprises:

(a) mounting a displaceable valve member adjacent a free end of a stationary nozzle for transverse sliding movement across and in close cooperation with said nozzle free end to cover and uncover, alternately, an aperture formed in that free end, said aperture being in communication with a supply source of said liquid;

(b) driving said valve member so as to cover and uncover said free end of said nozzle successively, and;

which method is characterized by the steps of:

(i) supplying said liquid to said aperture from a remotely disposed pressurized supply source through a delivery pipe which is thermally insulated so as to prevent said liquid from boiling while flowing therethrough;

(ii) exposing all parts of said valve member to said atmosphere except the part thereof which, for the time being, lies directly adjacent said nozzle end; and (iii) causing said liquid emerging from said aperture to flow from said nozzle end as a coherent jet and directly into said atmosphere.

21. A method according to claim 20, wherein said valve member is constituted by a wheel mounted for rotation and having a plurality of spaced radially-extending parts each of which on rotation of said wheel acts to alternatively cover and uncover said nozzle free end, and thereby periodically interrupt and re-establish the flow of said liquid jet from said nozzle end, and wherein said wheel is rotated to cause said liquid to be dispensed in said quantities.

22. A method according to claim 21, wherein said spaced radially-extending parts are defined by apertures formed in said wheel at positions spaced around said wheel.

* * * * *